United States Patent [19]

Ayliffe

[11] Patent Number: 4,638,310

[45] Date of Patent: Jan. 20, 1987

[54] METHOD OF ADDRESSING LIQUID CRYSTAL DISPLAYS

[75] Inventor: Peter J. Ayliffe, Bishops Stortford, England

[73] Assignee: International Standard Electric Company, New York, N.Y.

[21] Appl. No.: 647,567

[22] Filed: Sep. 6, 1984

[30] Foreign Application Priority Data

Sep. 10, 1983 [GB] United Kingdom ..... 8324304

[51] Int. Cl.[4] ..... G09G 3/36

[52] U.S. Cl. ..... 340/805; 340/784; 340/811; 350/333

[58] Field of Search ..... 340/718, 719, 783, 784, 340/802, 805, 811; 350/332, 333

[56] References Cited

U.S. PATENT DOCUMENTS

| | | | |
|---|---|---|---|
| 3,776,615 | 12/1973 | Tsukamoto et al. . | |
| 3,835,463 | 9/1974 | Tsukamoto et al. . | |
| 3,911,421 | 10/1975 | Alt et al. . | |
| 3,973,252 | 8/1976 | Mitomo et al. . | |
| 3,995,942 | 12/1976 | Kawakami et al. | 340/784 |
| 4,040,720 | 8/1977 | York . | |
| 4,060,801 | 11/1977 | Stein et al. . | |
| 4,082,430 | 4/1978 | Schulthess et al. . | |
| 4,100,540 | 7/1978 | Fujita et al. . | |
| 4,117,472 | 9/1978 | Freer et al. | 340/811 |
| 4,180,813 | 12/1979 | Yoneda . | |
| 4,187,505 | 2/1980 | Morley et al. . | |
| 4,206,459 | 6/1980 | Houryu et al. . | |
| 4,372,871 | 2/1983 | Toriyama et al. . | |
| 4,404,555 | 9/1983 | Long et al. | 340/784 |
| 4,427,978 | 1/1984 | Williams . | |
| 4,443,062 | 4/1984 | Togashi et al. . | |
| 4,511,926 | 4/1985 | Crossland et al. | 340/784 |
| 4,571,585 | 2/1986 | Stein et al. | 340/805 |

FOREIGN PATENT DOCUMENTS 0091661 7/1983 European Pat. Off. .

OTHER PUBLICATIONS

Chemical Abstracts, vol. 93: 58615r.
Chemical Abstracts, vol. 94: 56716w.
Chemical Abstracts, vol. 94: 166242w.
Chemical Abstracts, vol. 95: 89702n.
Chemical Abstracts, vol. 96: 133710k.
Chemical Abstracts, vol. 97: 47754s.
Chemical Abstracts, vol. 97: 171523e.
Chemical Abstracts, vol. 97: 228104a.
Chemical Abstracts, vol. 98: 26192n.
Chemical Abstracts, vol. 99: 14059g.
Chemical Abstracts, vol. 99: 222188a.

*Primary Examiner*—Gerald L. Brigance
*Attorney, Agent, or Firm*—J. M. May; T. L. Peterson

[57] ABSTRACT

A matrix array type liquid crystal device whose liquid crystal layer is ferro-electric is addressed using strobing pulses applied serially to the members of a set of electrodes on one side of the layer while balanced bipolar data pulses are applied in parallel to the members of a set of electrodes on the other side. The data pulses are twice the length of the strobing pulses. This provides a way of minimizing the exposure of the pixels to 'wrong' voltages between consecutive addressing that would tend to drive them to their opposite states.

14 Claims, 3 Drawing Figures

METHOD OF ADDRESSING LIQUID CRYSTAL DISPLAYS

BACKGROUND OF THE INVENTION

This invention relates to a method of addressing matrix array type ferro-electric liquid crystal display devices.

Hitherto dynamic scattering mode liquid crystal display devices have been operated using a d.c. drive or an a.c. one, whereas field effect mode liquid crystal devices have generally been operated using an a.c. drive in order to avoid performance impairment problems associated with electrolytic degradation of the liquid crystal layer. Such devices have employed liquid crystals that do not exhibit ferro-electricity, and the material interacts with an applied electric field by way of an induced dipole. As a result they are not sensitive to the polarity of the applied field, but respond to the applied RMS voltage averaged over approximately one response time at that voltage. There may also be frequency dependence as in the case of so-called two-frequency materials, but this only affects the type of response produced by the applied field.

In contrast to this a ferro-electric liquid crystal exhibits a permanent electric dipole, and it is this permanent dipole which will interact with an applied electric field. Ferro-electric liquid crystals are of interest in display applications because they are expected to show a greater coupling with an applied field than that typical of a liquid crystal that relies on coupling with an induced dipole, and hence ferro-electric liquid crystals are expected to show a faster response. A ferro-electric liquid crystal display mode is described for instance by N. A. Clark et al. in a paper entitled "Ferro-electric Liquid Crystal Electro-Optics Using the Surface Stabilized Structure" appearing in Mol. Cryst. Liq. Cryst. 1983. Volume 94, pages 213 to 234. Two properties of ferro-electrics set the problems of matrix addressing such devices apart from the addressing of non-ferro-electric devices. First they are polarity sensitive, and second their response times exhibit a relatively weak dependence upon applied voltage. The response time of a ferro-electric is typically proportional to the inverse square of applied voltage, or even worse, proportional to the inverse single power of voltage; whereas a non-ferro-electric smectic A, which in certain other respects is a comparable device exhibiting long term storage capability, exhibits a response time that is typically proportional to the inverse fifth power of voltage.

Therefore, a good drive scheme for addressing a ferro-electric liquid crystal display must keep to a minimum the incidence of wrong polarity signals to any given pixel, whether it is intended as an ON pixel or an OFF pixel.

SUMMARY OF THE INVENTION

According to the present invention, there is provided a method of addressing a matrix array type liquid crystal display device with a ferro-electric liquid crystal layer whose pixels are defined by the areas of overlay between the members of a first set of electrodes on one side of the liquid crystal layer and the members of a second set of electrodes on the other side of the layer, wherein strobing pulses are applied serially to the members of the first set while data pulses are applied in parallel to the second set in order to address the cell line by line, and wherein the waveform of a data pulse is balanced bipolar and twice the duration of a strobing pulse.

DESCRIPTION OF THE PREFERRED EMBODIMENTS

All three of the addressing schemes contemplated by the present invention address a display on a line by line basis using a parallel input of data pulses on a set of column electrodes while a strobing pulse is applied to each of the row electrodes in turn.

Figure 1:
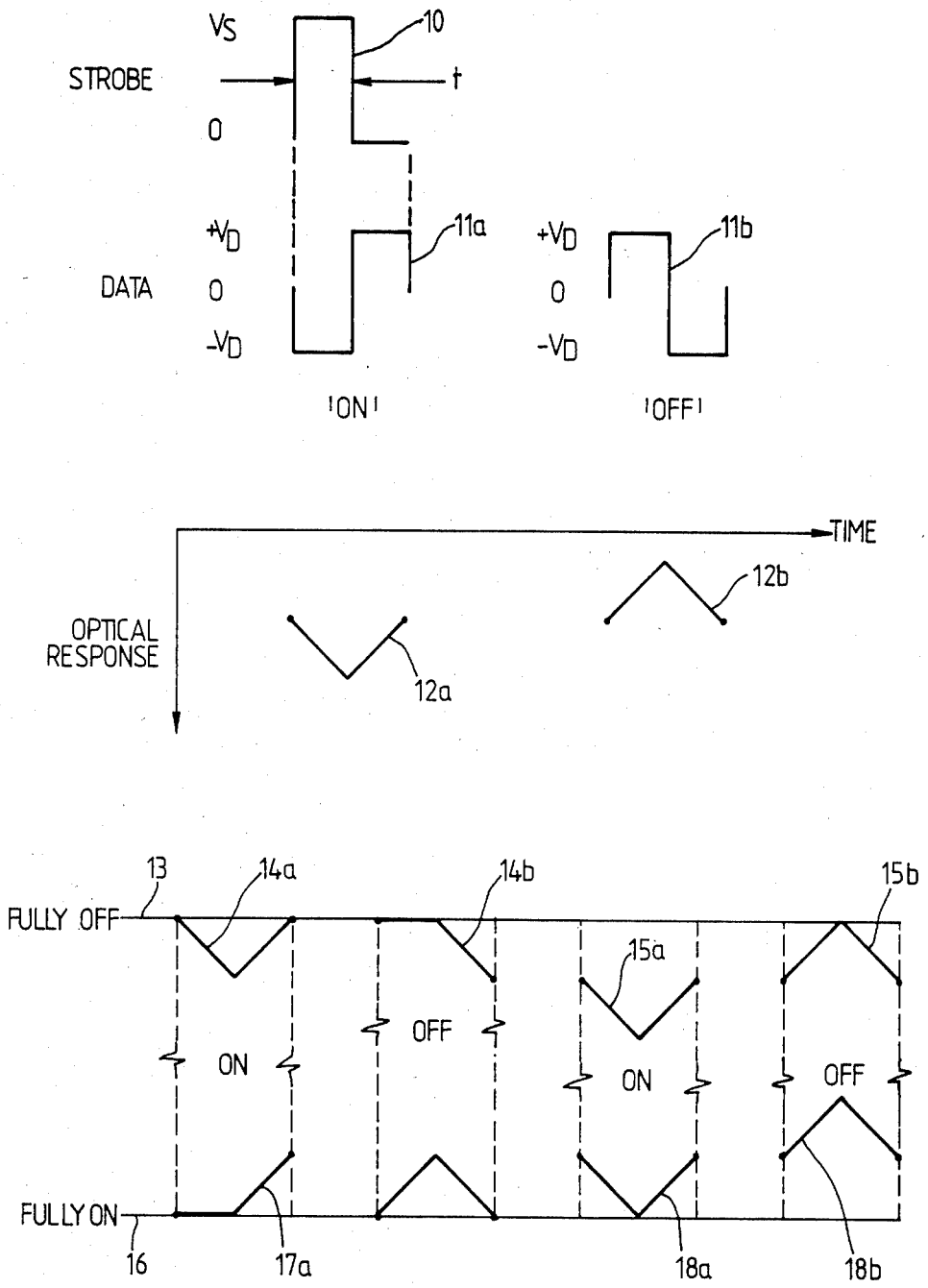
FIGS. 1 to 3 depict the waveforms associated with three alternative addressing schemes contemplated by the present invention.

In the scheme of FIG. 1, the strobe pulse voltage waveform 10 is a unidirectional pulse of height $V_s$ and duration t. An ON data pulse voltage waveform 11*a* is a balanced bipolar pulse making an excursion to $-V_D$ for a time t and then an excursion to $+V_D$ for a further time t. An OFF data pulse waveform 11*b* is the inverse of the ON data pulse waveform.

Any given pixel, which is defined by the area of intersection of a particular row electrode with a particular column electrode, will receive a succession of data pulses that address other pixels in the same column. When some other row is being strobed, the first half of an ON data pulse will tend to drive that pixel a little way towards the ON state, and then the second half will tend to drive it the same amount in the reverse direction and thus restore the status quo. This effect is depicted at 12*a*. Similarly, the effect of an OFF data pulse is first to tend to drive the pixel towards the OFF state, and then to restore the original state as depicted at 12*b*.

If the pixel is in a fully OFF state, as depicted by the line 13, the effect of ON data pulses is to drive the pixel a little way towards the ON state, and then restore the saturated OFF state, as depicted at 14*a*. The first OFF data pulse introduces a difference because the first half of such a pulse cannot drive the saturated OFF pixel any further OFF. The result is that at the end of the first OFF pulse a pixel previously in a fully saturated OFF state is driven a small amount ON, as depicted at 14*b*. Thereafter that pixel will make further temporary excursions either back to the fully OFF state, as depicted at 15*b*, or to a state that is slightly further ON, as depicted at 15*a*. However, it is to be particularly noted that there is no staircase effect because both types of data pulse end up by restoring the state that existed before commencement of the data pulse.

The fully ON state is depicted at 16, and it is seen that here there is an analogous situation, with the first ON data pulse driving the pixel a small amount OFF, as depicted at 17*a*. With any data pulse after the first ON data pulse, the pixel always comes to rest at this level at the end of the data pulse irrespective of whether the data pulse is an ON or an OFF pulse, as depicted at 18*a* and 18*b*.

Thus far consideration has been confined to the operation of the pixel while the strobing pulse is addressing other rows.

Considering first the effect of a strobe pulse coinciding with an ON data pulse, the strobe pulse coincides with the first half of the data pulse, and hence the combined effect in the first half of the data pulse is the application of a voltage of $(V_S+V_D)$ tending to turn the pixel ON. Then, in the second half of the data pulse, there is a voltage $V_D$ tending to turn the pixel OFF. In order for the pixel to be switched on by this sequence of events, it is clearly necessary for the ON voltage duration t, divided by the response time at that voltage $T_{(V_S+V_D)}$, to be greater than unity.

$$t/T_{(V_D+V_S)}>1$$

Considering now the effect of a strobe pulse coinciding with an OFF data pulse. The combined effect in the first half of the data pulse is the application of a voltage $(V_S-V_D)$ tending to turn the pixel ON. This is then followed in the second half by a further voltage $V_D$ also tending to turn the pixel ON. Clearly the "worst" case is when the pixel is not starting from the fully OFF state, but has already been turned partly ON by a preceding OFF data pulse. Under these conditions an OFF element has to withstand two pulses of duration t and voltage $V_D$, and a single pulse of duration t and voltage $V_S-V_D$ without switching on to any appreciable extent. This can be expressed by the relationship $$2t/T_{(V_D)}+t/T_{(V_S-V_D)}<<1$$

For a typical response characteristic this is satisfied by $$2t/T_{(V_D)}+t/T_{(V_S-V_D)}<1/10$$

Inspection of FIG. 1 reveals that if the strobing pulse is synchronized with the second halves of the data pulses instead of with their first halves, substantially the same situation prevails, though the roles of the data pulse waveforms are interchanged.

This first addressing scheme uses a unidirectional strobing pulse for data entry, and so it does not of itself permit the use of the data pulses to set some pixels into the ON state while at the same time setting others into the OFF state. Therefore, it is necessary to blank the cell before addressing. This can be done on a line-by-line basis by inserting a blanking pulse of opposite polarity to the strobing pulse onto the row electrode in the time interval terminating with the commencement of data entry for that row, and starting with the commencement of the data entry for the preceding line. Alternatively, blanking can be effected on a page basis by applying blanking pulses simultaneously to all the rows before starting a frame.

Figure 2:
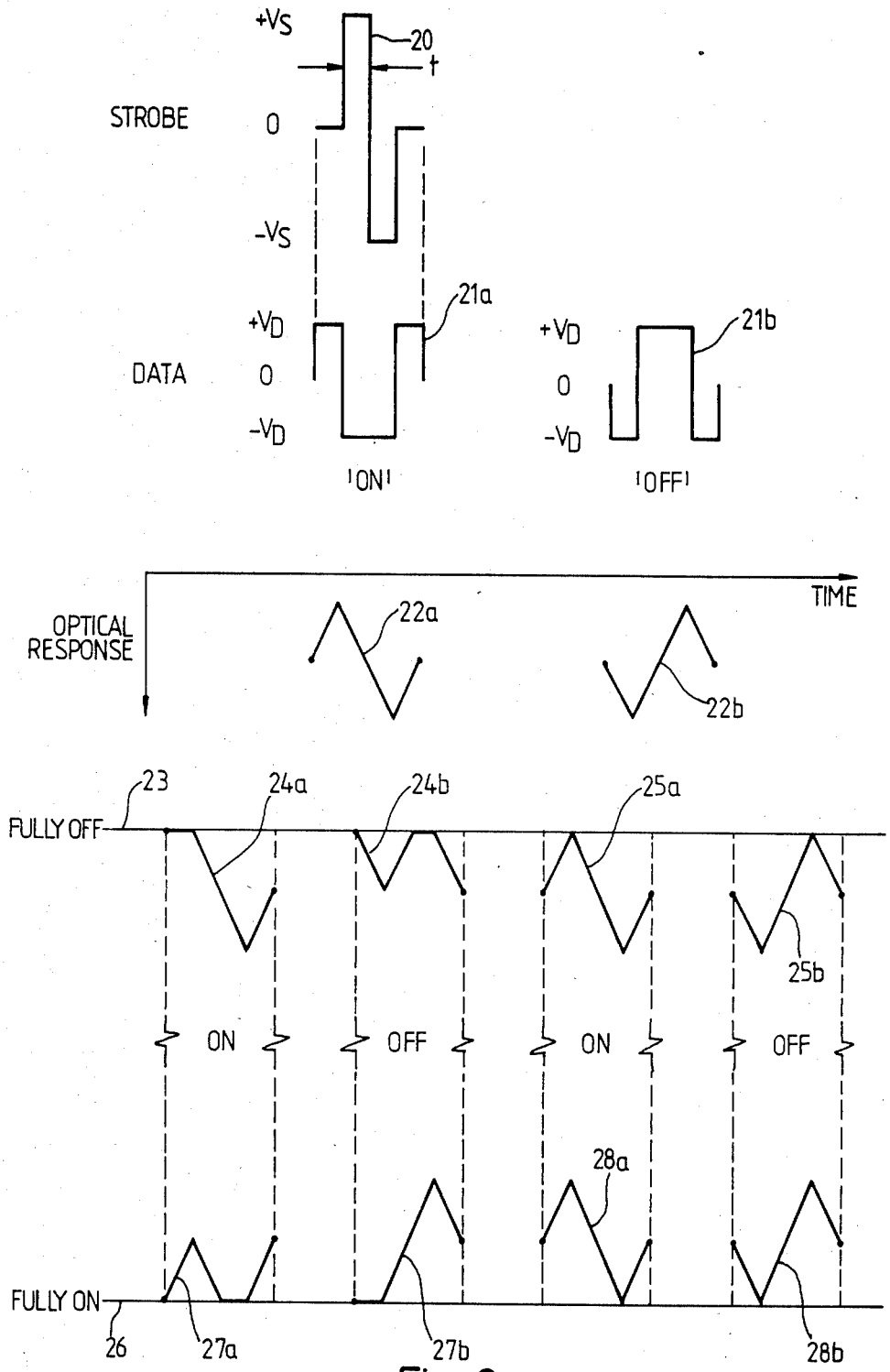

The addressing scheme of FIG. 2 uses a balanced bipolar strobing pulse waveform, and thus with this scheme it is possible for data to be entered and to be erased without recourse to page or line blanking techniques.

The first half of the FIG. 2 scheme strobe pulse 20 consists of a pulse of height $V_S$ and duration t. This is immediately followed by a pulse of height $-V_S$ and duration t. An ON data pulse voltage waveforem 21*a* is also a balanced bipolar pulse, and makes an excursion $+V_D$ for a time t, then an excursion to $-V_D$ for a time 2t, and finally an excursion to $+V_D$ again for a further time t. An OFF data pulse waveform 21*b* is the inverse of the ON data pulse waveform.

The effects of ON and OFF data pulse waveforms in the absence of any strobing pulses are depicted respectively at 22*a* and 22*b*. In this instance both types of data pulses have the effect, on their own, of leaving a pixel previously in a fully OFF state 23 in a state driven a small amount ON as depicted by waveforms 24*a* and 24*b*. Thereafter any further data pulse 25*a* or 25*b* that occurs in the absence of any strobing pulse causes the pixel to make temporary excursions towards and away from the fully OFF state, but finally leave the pixel in the same state it was in before the start of that further data pulse.

The fully ON state is depicted at 26, and it is seen that here there is an analogous situation insofar as both type of data pulse, occurring in the absence of a strobing pulse, leave a fully ON pixel driven a small way towards the OFF state as depicted by waveforms 27*a* and 27*b*. Once again it is to be noted that subsequently there is no staircase effect because any further data pulses 25*a*, 25*b*, 28*a* and 28*b*, occurring in the absence of strobing pulses each end up by restoring the state that existed before commencement of that pulse.

The strobing pulse is synchronized with the second and third quarters of a data pulse. Thus, in the case of a strobe pulse synchronized with an ON pulse waveform, the pixel is exposed to a voltage $(V_S+V_D)$ in the second quarter of the data pulse waveform, which is in a direction driving the pixel into the fully ON stage. In the third quarter, the pixel is exposed to a voltage $(V_S-V_D)$ tending to turn it OFF, and in the fourth quarter it is exposed to a voltage $V_D$ also tending it to turn it OFF. The complementary situation occurs in the case of a strobing pulse synchronized with an OFF data pulse waveform.

The requirement that the pixel be driven to saturation in the duration t of the second quarter of the data pulse waveform is once again given by the expression $$t/T_{(V_D+V_S)}>1$$

Since the third and fourth quarters of the data pulse waveform cooperate in tending to drive the pixel away from saturation, it is necessary to ensure that their combined effect is small enough not to remove the pixel from its saturated state to too significant an extent. This can be expressed by the relationship $$t/T_{(V_S-V_D)}+t/T_{(V_D)}<<1$$

or, making the same assumption as before, $$t/T_{(V_S-V_D)}+t/T_{(V_D)}<1/10$$

Figure 3:
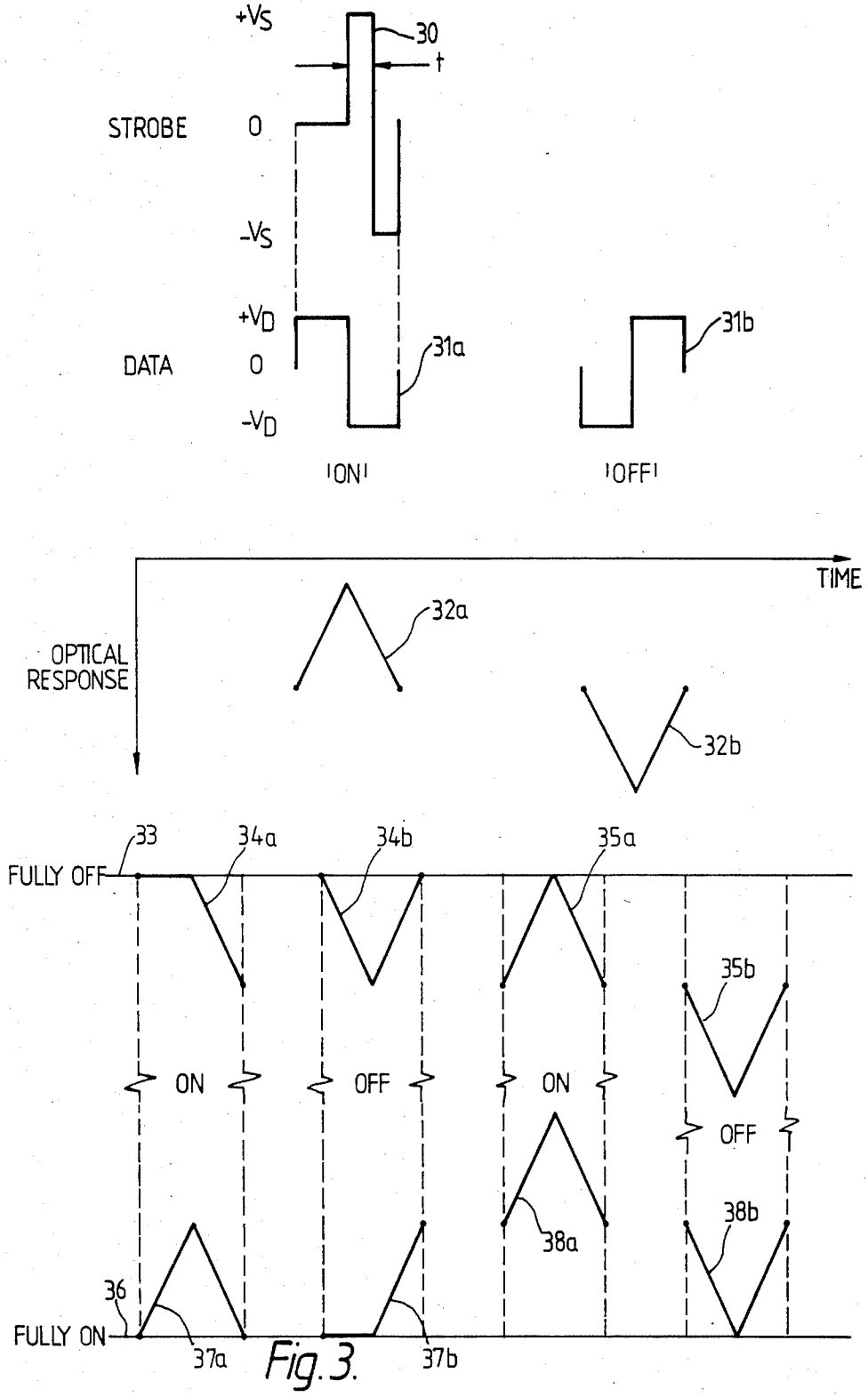

The addressing scheme of FIG. 3 uses the same form of balanced bipolar strobing pulse 30 as is employed in the scheme of FIG. 2, but in this instance it is synchronized with the third and fourth quarters of the data pulse waveforms instead of the second and third quarters. This change necessitates changes to the data pulse waveforms. An ON data pulse waveform 31*a* still retains a balanced bipolar format, and makes an excursion $+V_D$ for a time 2t for the first half of the waveform duration, and then an excursion to $-V_D$ for 2t to complete the waveform. The OFF data pulse waveform 31*b* is, as before, the inverse of the ON data pulse waveform.

The effects of ON and OFF data pulse waveforms in the absence of any strobing pulses are depicted respectively at 32*a* and 32*b*. As depicted by waveform 34*b*, an OFF data pulse waveform on its own has the effect of leaving in a fully OFF state a pixel that was previously in the fully OFF state 33. Similarly as depicted by waveform 37*a*, an ON data pulse waveform on its own has the effect of leaving in a fully ON state a pixel that was previously in the fully ON state 36. In contrast to this ON or OFF data pulse waveforms that are applied on their own to pixels that are respectively in their fully OFF and fully ON states have the effect of leaving those pixels in states that are driven slightly away from saturation, as depicted respectively by waveforms 34*a* and 37*b*, by a voltage excursion of $V_D$ maintained for a duration 2t.

The use of balanced bipolar data pulse waveforms again ensures that a succession of data pulses is incapable of producing a staircase effect. Once the condition is reached that a data pulse waveform does not attempt to drive a pixel beyond saturation, further data pulses, occurring in the absence of strobing pulses, will each leave a pixel in the state it was in before the start of that pulse.

Inspection of the three waveforms 30, 31*a* and 31*b* reveals that when a strobing pulse is synchronized with an ON data pulse, the pixel is exposed to a voltage $(V_S+V_D)$ in the third quarter that tends to drive the pixel into the ON state. This is followed in the fourth quarter by exposure to a voltage $(V_S-V_D)$ that tends to turn it OFF. When a strobing pulse is synchronized with an OFF data pulse waveform the pixel does not see the full drive voltage of $(V_S+V_D)$ until the fourth quarter. The requirement that the full drive voltage shall drive the pixel to saturation in the time t of its duration is again given by the expression.

$$t/T_{(V_S+V_D)}>1$$

Since, in the presence of a strobing pulse, the fourth quarter of the On data pulse waveform exposes the pixel to a voltage $(V_S-V_D)$ that tends to turn the pixel OFF it is necessary to ensure that this does not remove the pixel from its ON state to too significant extent. This requirement can be expressed by the relationship $$t/T_{(V_S-V_D)}<<1$$

This is, however, not the only requirement because, as explained above, data pulses are on their own liable to drive a pixel away from saturation by a voltage excursion of $V_D$ lasting for a duration 2t. Therefore this is the further requirement that these data pulses do not remove pixels from their saturation states to too significant an extent. This requirement can be expressed by the relationship $$2t/T_{V_D}<<1$$

Making the same assumption as before, these last two relationships can be expressed as $$t/T_{(V_S-V_D)}<1/10 \text{ and}$$

$$2t/T_{V_D}<1/10$$

A similar situation pertains if the strobe pulse is synchronized with the first and second quarters of the data pulses instead of with their third and fourth quarters, but in this instance the roles of the data pulses are reversed.

The absolute magnitudes of $V_s$, $V_D$, and t will depend upon the characteristics of the particular display device concerned. In some cases the choice can be quite critical unless the 'one tenth' criterion is relaxed. Thus for instance, with the characteristics quoted by N. A. Clark and S. T. Lagerwall in "Recent Developments in Condensed Matter Physics," Volume 4 (1981) pp 309 to 319, without relaxing this criterion it has not been found possible to use the scheme of FIG. 1 at all, while the scheme of FIG. 2 will just function for an address time t of 15 microseconds with $V_S=2.70$ volts and $V_D=1.37$ volts, but will not function if the address time t is reduced to 10 microseconds or expanded to 20 microseconds. (In this context it is to be noted that for the schemes of FIGS. 2 and 3 the line time is equal to 4t.) However, the scheme of FIG. 3 is easier to operate under these conditions and will operate for example with t=10 microseconds
$V_S=3.43$ volts
$V_D=1.57$ volts with t=20 microseconds
$V_S=2.44$ volts
$V_D=1.00$ volts or with t=30 microseconds
$V_S=2.01$ volts
$V_D=0.89$ volts In the foregoing specific description each of the three examples has used a strobing pulse length that is exactly half the length of a data pulse, but it will be evident that at least in principle it would be possible to extend the data pulses, while preserving their balanced format, and thus make the duration longer than twice that of a strobing pulse. Such a procedure would have the disadvantage of slowing the speed, and hence is not generally to be desired.

What is claimed is:

1. A method of addressing a matrix array type liquid crystal display device with a ferro-electric liquid crystal layer whose pixels are defined by the areas of overlay between the members of a first set of electrodes on one side of the liquid crystal layer and the members of a second set of electrodes on the other side of the layer, and whose pixels exhibit optical properties when selectively operated to fully on and fully off states, wherein strobing pulses are applied serially to the members of the first set while data pulses are applied in parallel to the second set in order to address the cell line by line, and wherein the waveform of a data pulse is balanced bipolar and at least twice the duration of a strobing pulse, and wherein the balanced bipolar data pulse when applied to a non-addressed pixel in other than a fully on state or fully off state restores such pixel to its original condition at the end of the data pulse.

2. A method as claimed in claim 1, wherein the duration of a data pulse is twice that of a strobing pulse.

3. A method as claimed in claim 1, wherein a bipolar data pulse is one of positive and negative going in the first half of the pulse duration and the other of negative and positive going in the second half, and wherein the strobing pulses are unidirectional and always synchronized with one of the first and second halves of the data pulses.

4. A method as claimed in claim 2, wherein a bipolar data pulse is one of positive and negative going in the first half of the pulse duration and the other of negative and positive going in the second half, and wherein the strobing pulses are unidirectional and always synchronized with one of the first and second halves of the data pulses.

5. A method as claimed in claim 3, wherein prior to the addressing of the pixels associated with any particular member of the first set of electrodes these pixels are all erased by a blanking pulse applied to that member of the first set of electrodes, which blanking pulse is of opposite polarity to that of the strobing pulses and is applied at or after the commencement of the bipolar data pulses used to address the pixels associated with the member of the first set of electrodes to which the strobing pulse is applied immediately preceding its application to that said particular member.

6. A method as claimed in claim 4, wherein prior to the addressing of the pixels associated with any particular member of the first set of electrodes these pixels are all erased by a blanking pulse applied to that member of the first set of electrodes, which blanking pulse is of opposite polarity to that of the strobing pulses and is applied at or after the commencement of the bipolar data pulses used to address the pixels associated with the member of the first set of electrodes to which the strobing pulse is applied immediately preceding its application to that said particular member.

7. A method as claimed in claim 1, wherein the waveform of a strobing pulse is balanced bipolar.

8. A method as claimed in claim 2, wherein the waveform of a strobing pulse is balanced bipolar.

9. A method as claimed in claim 7, wherein the waveform of a data pulse exhibits one polarity in the first and fourth quarters of its duration and the opposite polarity in the second and third quarters, and wherein the waveform of a strobing pulse is synchronized with the second and third quarters and exhibits one polarity in the second quarter and the opposite polarity in the third quarter.

10. A method as claimed in claim 8, wherein the waveform of a data pulse exhibits one polarity in the first and fourth quarters of its duration and the opposite polarity in the second and third quarters, and wherein the waveform of a strobing pulse is synchronized with the second and third quarters and exhibits one polarity in the second quarter and the opposite polarity in the third quarter.

11. A method as claimed in claim 7, wherein the waveform of a data pulse exhibits one polarity in the first half of its duration and the opposite polarity in the second half, wherein the waveform of a strobing pulse is synchronized with the second half and exhibits one polarity in the first half of its duration and the opposite polarity in the second.

12. A method as claimed in claim 8, wherein the waveform of a data pulse exhibits one polarity in the first half of its duration and the opposite polarity in the second half, wherein the waveform of a strobing pulse is synchronized with the second half and exhibits one polarity in the first half of its duration and the opposite polarity in the second.

13. A method as claimed in claim 7, wherein the waveform of a data pulse exhibits one polarity in the first half of its duration and the opposite polarity in the second half, wherein the waveform of a strobing pulse is synchronized with the first half and exhibits one polarity in the first half of its duration and the opposite polarity in the second.

14. A method as claimed in claim 8, wherein the waveform of a data pulse exhibits one polarity in the first half of its duration and the opposite polarity in the second half, wherein the waveform of a strobing pulse is synchronized with the first half and exhibits one polarity in the first half of its duration and the opposite polarity in the second.

* * * * *